US006802165B1

(12) United States Patent
Passeno

(10) Patent No.: US 6,802,165 B1
(45) Date of Patent: Oct. 12, 2004

(54) THIN BRICK PANEL CONSTRUCTION

(76) Inventor: J. Kenneth Passeno, 116 W. State Rd., Grant, MI (US) 49327

( * ) Notice: Subject to any disclaimer, the term of this patent is extended or adjusted under 35 U.S.C. 154(b) by 0 days.

(21) Appl. No.: 09/533,200

(22) Filed: Mar. 23, 2000

Related U.S. Application Data

(60) Provisional application No. 60/126,558, filed on Mar. 26, 1999.

(51) Int. Cl.[7] ..... E04F 13/14

(52) U.S. Cl. ..... 52/387; 52/288.1; 52/389

(58) Field of Search ..... 52/385, 386, 387, 52/389, 288.1, 384

(56) References Cited

U.S. PATENT DOCUMENTS

| | | | | | |
|---|---|---|---|---|---|
| 520,137 | A | | 5/1894 | Deslauriers | |
| 874,909 | A | | 12/1907 | Fischer | |
| 1,555,414 | A | | 9/1925 | Hale | |
| 2,003,996 | A | | 6/1935 | Finzer et al. | |
| 2,043,706 | A | * | 6/1936 | Myers | 52/387 |
| 2,054,511 | A | * | 9/1936 | Hornicek | 52/385 |
| 2,101,612 | A | | 12/1937 | Duffy | |
| 2,132,547 | A | | 10/1938 | Sohn | |
| 2,200,649 | A | | 5/1940 | Wardle | |
| 2,213,355 | A | | 9/1940 | Woodworth | |
| 2,300,258 | A | | 10/1942 | Kublanow | |
| 2,317,428 | A | | 4/1943 | Anderson | |
| 2,791,117 | A | | 5/1957 | Bailey | |
| 2,919,572 | A | | 1/1960 | Salzi | |
| 2,924,963 | A | | 2/1960 | Taylor et al. | |
| 2,938,376 | A | | 5/1960 | Workman et al. | |
| 3,331,180 | A | | 7/1967 | Vissing et al. | |
| 3,434,257 | A | | 3/1969 | Sakuma | |
| 3,520,095 | A | | 7/1970 | Jonason et al. | |
| 3,533,206 | A | * | 10/1970 | Passeno, Jr. | 52/387 |
| 3,908,326 | A | | 9/1975 | Francis | |
| 4,011,702 | A | * | 3/1977 | Matyas | 52/389 |
| 4,238,915 | A | | 12/1980 | Yoshida et al. | |
| 4,244,155 | A | | 1/1981 | Swiger | |
| 4,407,104 | A | | 10/1983 | Francis | |
| 4,407,107 | A | | 10/1983 | Smith, Jr. | |
| 4,641,473 | A | | 2/1987 | Trezza | |
| 4,662,140 | A | | 5/1987 | Porter et al. | |
| 4,736,552 | A | | 4/1988 | Ward et al. | |
| 4,773,201 | A | | 9/1988 | Trezza | |
| 4,809,470 | A | | 3/1989 | Bauer et al. | |
| 4,856,245 | A | | 8/1989 | Osawa | |
| 4,956,949 | A | | 9/1990 | Francis | |
| 4,987,712 | A | * | 1/1991 | Mancuso | 52/387 |
| 5,006,011 | A | * | 4/1991 | Hiyashi | 52/387 |

* cited by examiner

*Primary Examiner*—Michael Safavi
(74) *Attorney, Agent, or Firm*—McGarry Bair PC

(57) ABSTRACT

A building block holder for securely holding thin bricks or other building blocks in a spaced relationship on a wall comprises a panel formed of sheet material that is adapted to be fastened to the side of a building. The panel has rows of spaced block support elements in the form of stamped, inclined, V-shaped prongs that extend outwardly from the panel such that when the gap between the blocks is filled with mortar, the mortar flows behind the prongs and thereby locks the building blocks on the panel. The panel also includes glue lock openings behind the blocks for more securely locking the bricks to the panel. A plurality of rearwardly deformed portions on the panel space the panel outwardly from a substrate and serve as water drains and recessed locations through which mounting screws can be extended. A lower edge of the panel is displaced outwardly from a rear surface of the panel such that an upper edge of the panel below will fit behind the lower edge. The building block holder further includes a shelf for mounting elongated blocks on their ends, a corner element that fits on the corner of a building, an outwardly extending flange that runs along the lower end of the panel, and a J-shaped panel edge connection.

8 Claims, 6 Drawing Sheets

THIN BRICK PANEL CONSTRUCTION

CROSS-REFERENCES TO RELATED APPLICATIONS

This is a continuation application of co-pending U.S. Provisional Patent Application Serial No. 60/126,558, entitled Thin Brick Panel Construction and filed on Mar. 26, 1999 by J. Kenneth Passeno, the disclosure of which is incorporated here by reference.

STATEMENT REGARDING FEDERALLY SPONSORED RESEARCH OR DEVELOPMENT

Not Applicable.

BACKGROUND OF THE INVENTION

The present invention relates to an improved building block holder used to support and position building blocks, such as so called "thin bricks", which are used as surface panels for buildings.

In traditional building construction, block walls are formed by stacking blocks one at a time on top of each other with a layer of mortar between the blocks. Such construction is typical for brick walls as well as walls formed of other types of building block materials. Such walls are aesthetically pleasing but the materials are expensive and the walls are expensive to fabricate and are poor insulators.

A less expensive alternative is a so-called "thin brick" wall construction, wherein thinner bricks are mounted on building block holders in the form of flat support panels that are affixed to the sides of the building. Gaps between the thin bricks are filled with traditional mortar, so that the finished panel has the same visual effect as a traditional brick wall. However, the panels are thinner and are less expensive and easier to install. Such panels also facilitate the incorporation of efficient insulating materials, such as foam board, between the panel and the building walls.

One problem with the use of thin bricks is that they can sometimes become separated from the support panels on which they are mounted. The traditional way for affixing thin bricks to support panels is by a conventional adhesive. If the adhesive releases, the bricks can fall off the panels. Some systems have used separately attachable clips that incorporate devices to lock mortar on the panel but these are extra elements, involve extra expense, and provide only a limited number of attachment locations of limited effectiveness.

An object of the present invention is to provide an improved building block holder for building blocks such as thin bricks or the like, wherein the building blocks are positively locked to a support panel by a plurality of integral, durable mortar locks that lock the mortar to the panel. Another object is to provide mortar locks that not only lock the mortar to the panel, and thus hold the bricks to the panel, but also serve as flanges that support the bricks in horizontal rows.

SUMMARY OF THE INVENTION

The present invention comprises an improved building block holder for supporting and positioning thin bricks or other building blocks in a spaced relationship on a wall, wherein gaps between the blocks are filled with mortar. The building block holder comprises a support panel formed of sheet material that is adapted to be fastened to the side of a building. The panel comprises a plurality of rows of integral, spaced building block support elements extending outwardly from the panel, with the rows being spaced vertically apart by the height of the blocks and the desired gap between the blocks. The block support elements have at least a portion thereof that extends at a nonperpendicular angle with respect to the panel, such that there is an open mortar space behind that portion of the elements. Thus, when the gap between the blocks is filled with mortar, the mortar penetrates the space behind the elements. When the mortar dries, the mortar is locked on the panel by engagement with a rear side of the nonperpendicular portion of the elements. The mortar, in turn, locks the blocks on the panel by engagement with the blocks.

The block supporting elements of the present invention desirably are formed in the shape of upwardly and outwardly extending prongs having vertically positioned reinforcing ribs therein. This gives the prongs a rigid construction that resists deformation during storage or handling of the panels and prevents the prongs from bending downwardly when building blocks are placed thereon.

The present invention also incorporates rearwardly deformed portions adjacent the bricks that serve to space the panel away from a substrate and also provide a recessed location for mounting fasteners and a water channel for directing water from behind the panels.

The present invention also includes integral glue locks positioned so as to be adjacent a rear portion of the bricks. The glue locks comprise openings in the panels or nonperpendicular projections from the panels such that adhesive used to attach the bricks to the panels can penetrate to a position behind the projections or behind the panel so as to lock the glue on the panel and thereby lock the bricks on the panel.

The present invention includes a number of additional accessory features, including a shelf for mounting bricks on their ends, a corner bracket for mounting L-shaped bricks to the corner of a building, and an edge connector in the form of a J-piece for attaching the edge of a panel to a building.

These and other features of the present invention are described in detail below and shown in the appended drawings.

DETAILED DESCRIPTION OF THE INVENTION

Figure 1:
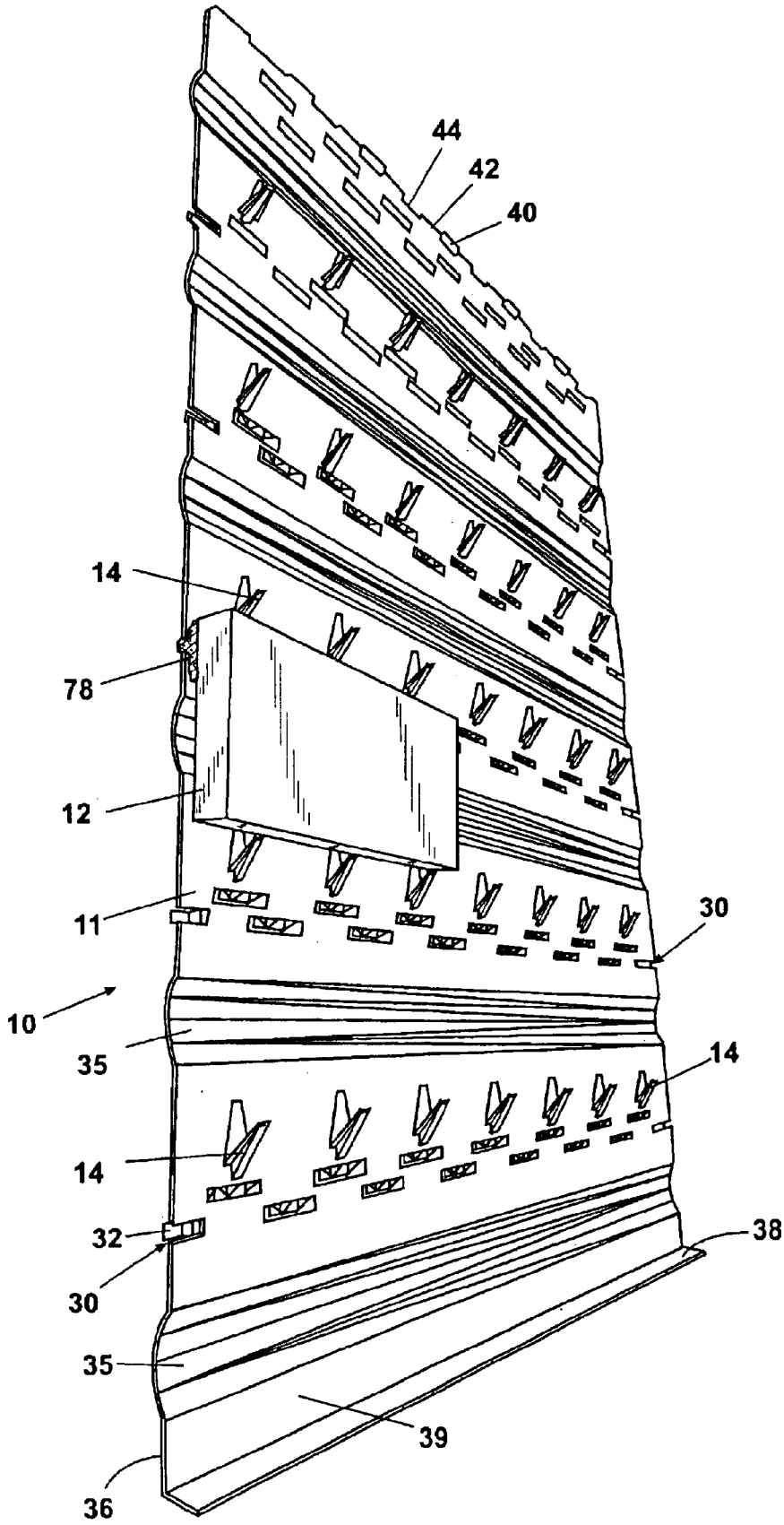
FIG. 1 is a perspective view of a building block holder constructed in accordance with the present invention.
Figure 3:
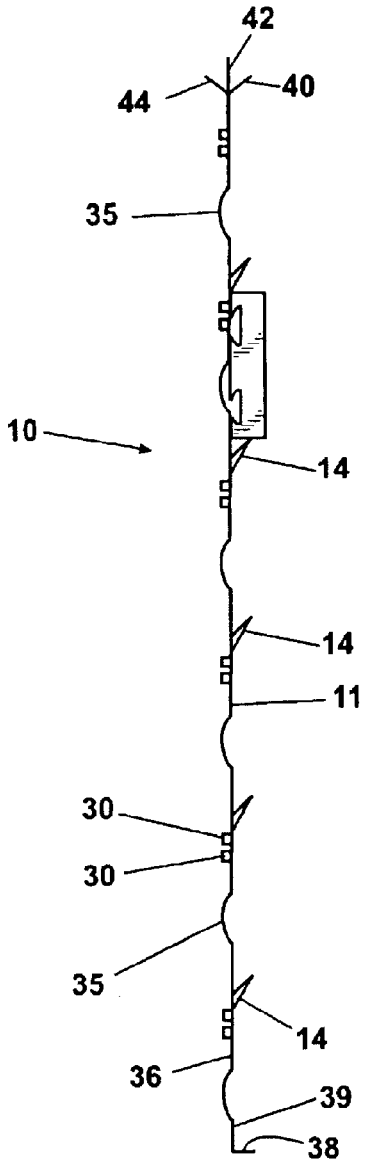
FIG. 3 is a sectional view taken along lines 3—3 of FIG. 2.
Figure 2:
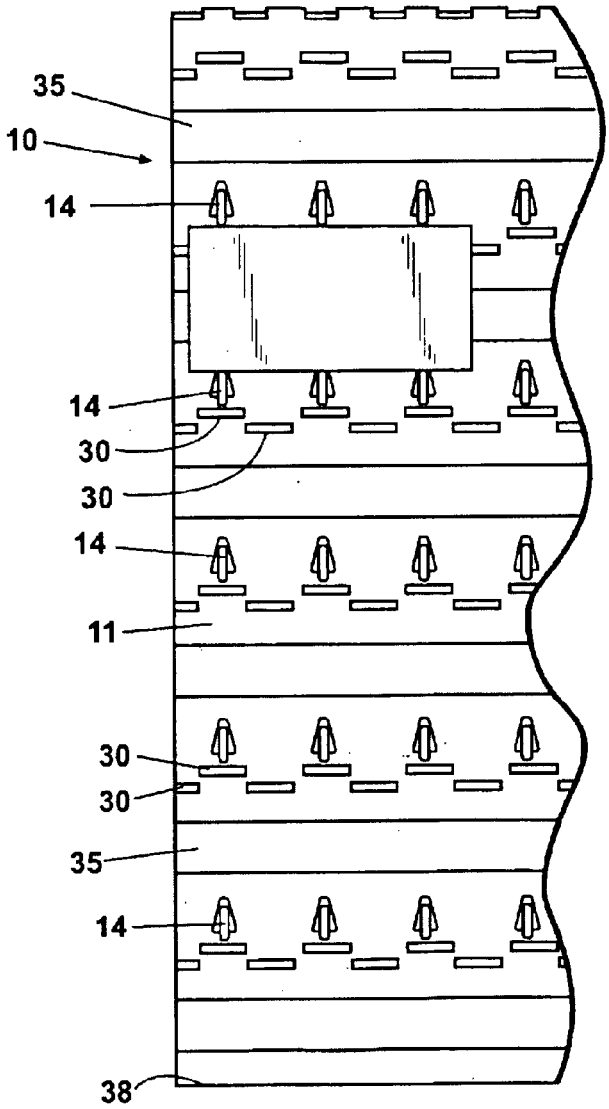
FIG. 2 is a plan view of the building block holder of FIG. 1.

Referring to the drawings, a building block holder 10 for supporting a plurality of thin building blocks 12 such as blocks known as thin bricks, is shown in FIG. 1. Block holder 10 comprises a flat panel 11 formed from a sheet material suitable for use in building construction. Preferably the material is a sheet metal of the type that resists corrosion. A galvanized sheet metal is desirable. Other materials could be employed. Typically a panel is about two feet high and about sixteen inches wide.

Panel 11 comprises a series of rows of block support elements 14, each spaced horizontally apart along the panel. The block support elements are spaced far enough apart that they provide a multiple point support for bricks 12 placed on the support elements. A typical thin brick might be seven and one half inches long, two and one quarter inches high, and one half inch thick. The brick support elements are conveniently positioned about two and one eighth inches apart in such a construction, so that each brick is supported by multiple brick support elements along its length.

The construction of the brick support elements is shown in more detail in FIGS. 5–8. Each brick support element 14 comprises an outwardly inclined prong 16 preferably formed by being stamped out of a triangular section of panel 11. This leaves a triangular opening 18 in the panel after the prong has been stamped outwardly therefrom. Prong 16 includes a nonplanar corrugation or rib 20 that extends upwardly along the length of the prong for purpose of reinforcing the rigidity of the prong. This makes the prong less likely to become deformed during storage, handling, or shipping, and also makes the prong less resistant to downward bending when a block is placed thereon. The prong's form thus has the general shape of a spout. The nonperpendicular or angular position of the prong with respect to the panel creates a space 28 behind a rear surface 22 of the prong for receiving mortar 24 (see FIG. 4). The spaces behind the block support elements and the openings in the panel behind the block support elements serve as mortar locks for locking mortar on the panel after mortar has been applied in the gaps 26 between the bricks. Typically, the gap between the bricks is about one half inch wide. When mortar penetrates space 28 behind rear surface 22 of the block support elements and when the mortar further penetrates through the panel through opening 18 and thereafter is permitted to dry, the mortar engages the rear surface of the panel and rear surface of the block support elements and is thereby locked on the panel by affirmative mechanical action. Since the mortar also engages and locks the bricks in position in the mortar when the mortar hardens, the mortar locks serve to lock the entire sheet of brick and mortar on the panel.

Figure 4:
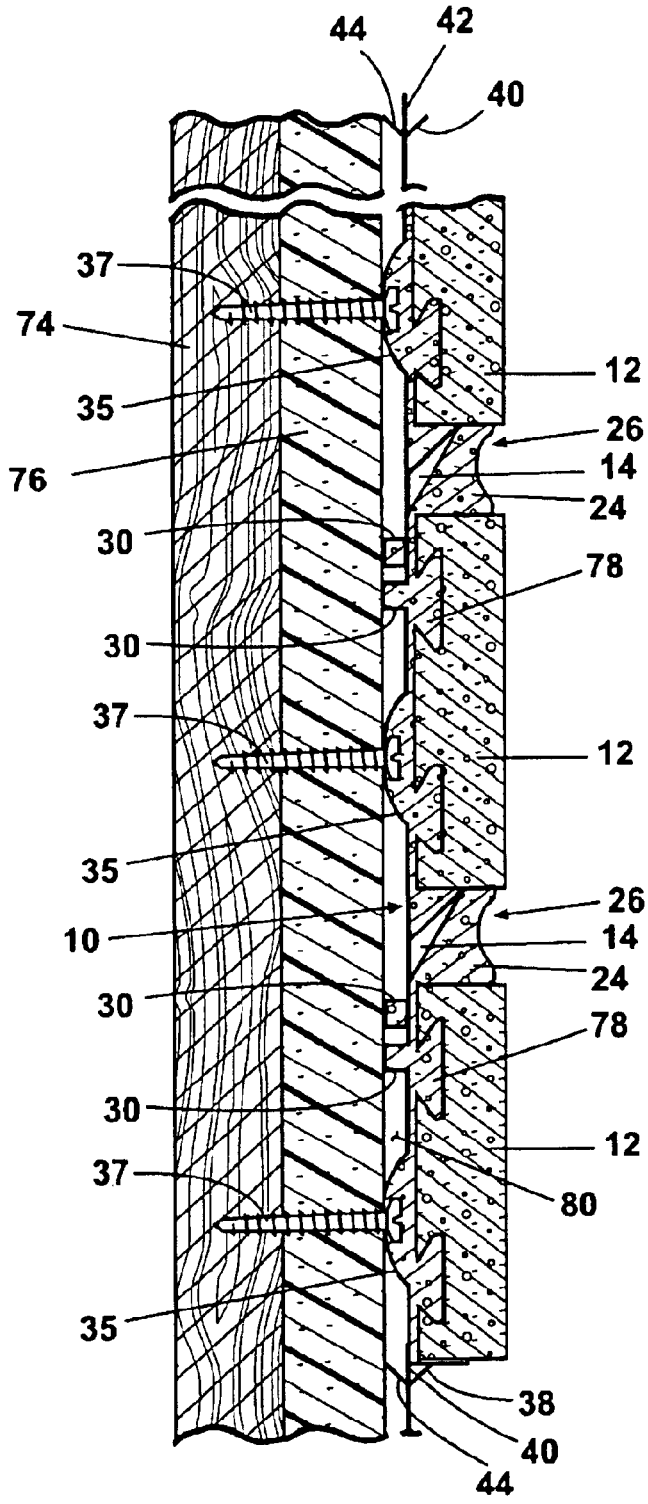
FIG. 4 is a fragmentary side edge sectional view showing the block holder of the present invention in connection with a block wall assembled on the wall of a building.
Figure 5:
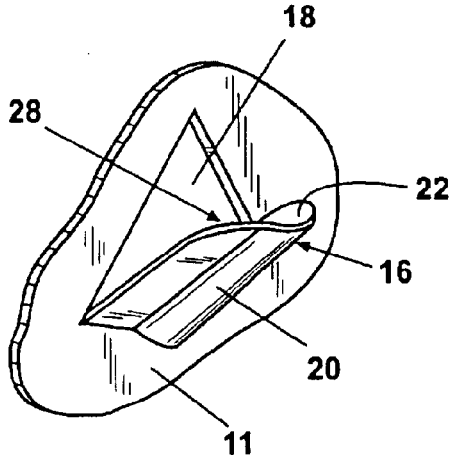
FIG. 5 is a fragmentary perspective view showing the brick support prong and mortar lock of the present invention. to FIG. 6 is front elevational view of the prong of FIG. 5.
Figure 6:
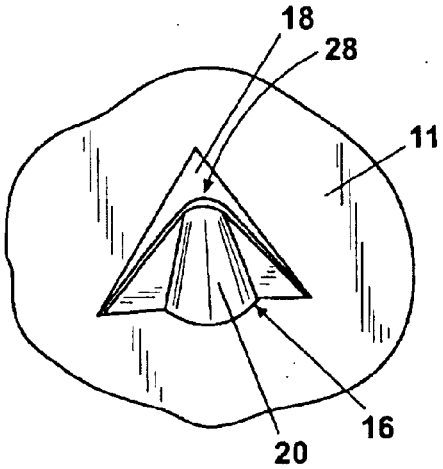
Figure 7:
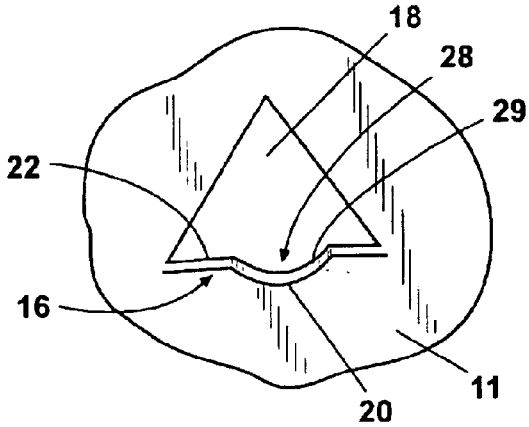
FIG. 7 is an end view of the prong of FIG. 5.
Figure 8:
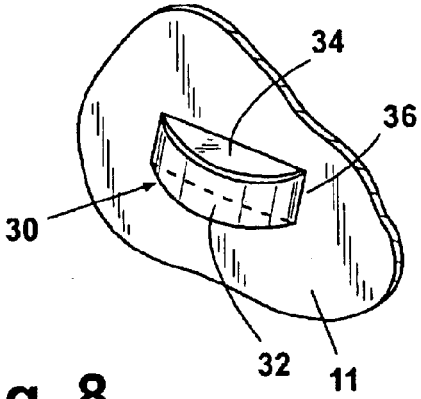
FIG. 8 is a fragmentary view of the rear side of the panel showing the glue lock of the present invention.

The panel also includes a plurality of glue locks 30 spaced in horizontal rows along the panel at a position just below the brick support elements. These glue locks are desirably lance openings 34 shaped so as to provide an arcuate segment 32 extending rearwardly from an opening in the panel, as shown in FIG. 8. As shown in FIG. 4, bricks are attached to the panel by applying glue to the panel and then resting the bricks on the prongs. The glue is applied to the area of the panel covered by the glue locks. The glue flows at least partially through the openings 34 in the panel and outwardly adjacent the rear side 36 of the panel. This causes the glue to become locked to the panel when the glue dries. The glue also penetrates the pores of the brick and secures the brick to the panel.

Another element of the panel is a plurality of longitudinal recesses or grooves 35 in the panel, generally formed by roll forming the panel. The longitudinal recesses serve a number of purposes. First, they serve as spacers to space the panel away from the substrate. With the panel spaced away from the substrate, the glue lock segments 32 can extend rearwardly from the panel as shown in FIG. 8, and there is a space behind the panel adjacent the glue locks and adjacent the brick support elements. Thus, when mortar and glue enter the openings in the glue locks and in the panel adjacent the prongs, mortar and glue can flow completely through the panel and at least partially behind the panel in order to provide a more secure lock for the mortar and glue to the panel.

The grooves or recesses 35 in the panel also serve to reinforce the panel and to channel liquid flow from the panel. They also serve as recessed locations for inserting screws 37 into the panel to mount the panel to a substrate. With the recessed location, the heads of the screws will always be recessed below the surfaces of the blocks and will not interfere with the positions of the blocks.

At the bottom of the panel, a flange 38 extends outwardly at right angles. Bricks are placed on the lower flange 38 and glued to the panel in the same manner as bricks attached elsewhere to the panel. At the top of the panel, tabs 40 spaced along the top edge of the panel are deflected outwardly at a forty-five degree angle. These tabs alternate with vertical tabs 42 and tabs 44 that are inclined in an opposite direction along the top edge of the panel. These tabs act as a further spacer from the substrate and also engage and position the lower end of the next adjacent panel above, while at the same time holding the top edge of the panel behind the lower end of the panel above.

The panel configuration can be modified at the top of a wall so as to eliminate prongs at the top. Whereas, a normal panel may be two feet high, separate panel sections sixteen and eight inches high can be used at the top of the wall. The sixteen inch section can have prongs on the lower part.

Figure 9:
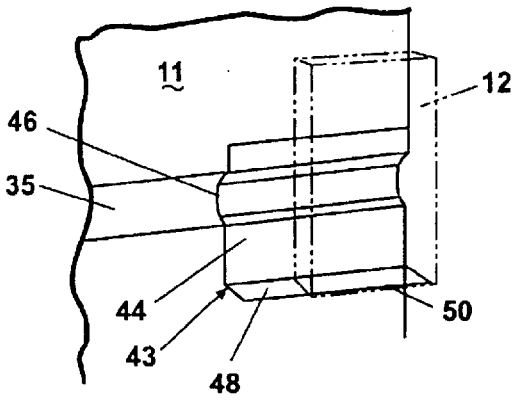
FIG. 9 is a perspective view showing a shelf for mounting bricks on their ends.
Figure 10:
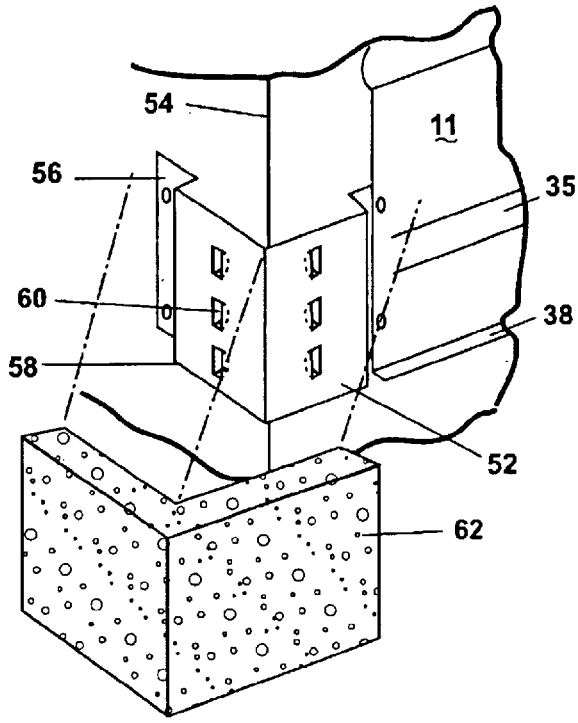
FIG. 10 is a perspective view showing a corner panel employed in the present invention.
Figure 11:
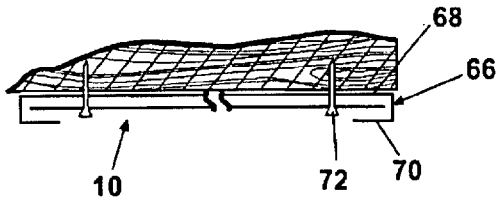
FIG. 11 is an top edge view showing a J-shaped edge piece for attaching the edges of a panel to a substrate.

A number of accessories for the present system are shown in FIGS. 9–11. In FIG. 9, a shelf 43 is employed for bricks that are to be mounted endwise on the panel. The shelf 43 provides a wider, more stable base for endwise bricks. Shelf 43 comprises an upright back plate 44 having a groove 46 therein that fits in groove 35 in the panel. A lower perpendicular shelf 48 extends outwardly and supports the lower end 50 of an endwise positioned brick.

The brick holder of the present invention also includes a corner panel 52 that fits on the corner 54 of a building. Corner panel 52 comprises a section of sheet metal formed into a right angle bend, with each side of the bend including a corner brick mounting surface 58 and an offset tab 56 at the end for attaching the corner panel to the building. Surface 58 is spaced away from the building, and lance openings 60 or other suitable openings in the panel serve as glue locks for an L-shaped corner brick 62. A normal panel 11 of the type described above is screwed on the offset tabs 56, as shown in FIG. 10.

The edges of a panel can be fastened to the substrate by means of J-shaped channel members 66, as shown in FIG. 11. Inner leg 68 extends inwardly further than outer leg 70 of J-shaped member 66, so that a screw 72 or rivet can extend through leg 68 without extending through leg 70.

In operation, the panels are first attached to a substrate by screws or the like. The substrate may be studs 74 on the side of a building and may include foam board 76 or other insulation panel on the outside of the building (FIG. 4). Other construction methods or components also could be used. The building blocks are then mounted on individual panel members by a conventional adhesive glue 78. The glue is applied adjacent the glue locks so that the glue penetrates the panel and becomes at least partially locked behind a portion of the panel. After the glue has cured, mortar is applied to the gaps between the bricks. The mortar flows behind the prongs that support the bricks and also flows through the openings 18 in the panel behind the prongs and penetrates the space behind the panel itself. When the mortar dries, the mortar thereby becomes locked to the panels and in turn locks the bricks to the panels. The prongs thus serve the dual purpose of supporting and positioning the bricks, while serving as mortar lock for locking the mortar and thereby locking the bricks to the panel. When a panel relies solely on glue to hold the blocks to the panel surface, the glue sometimes breaks and releases blocks from the panel. With the mortar serving as an additional locking means for the blocks, the blocks are locked permanently on the panels.

Figure 12:
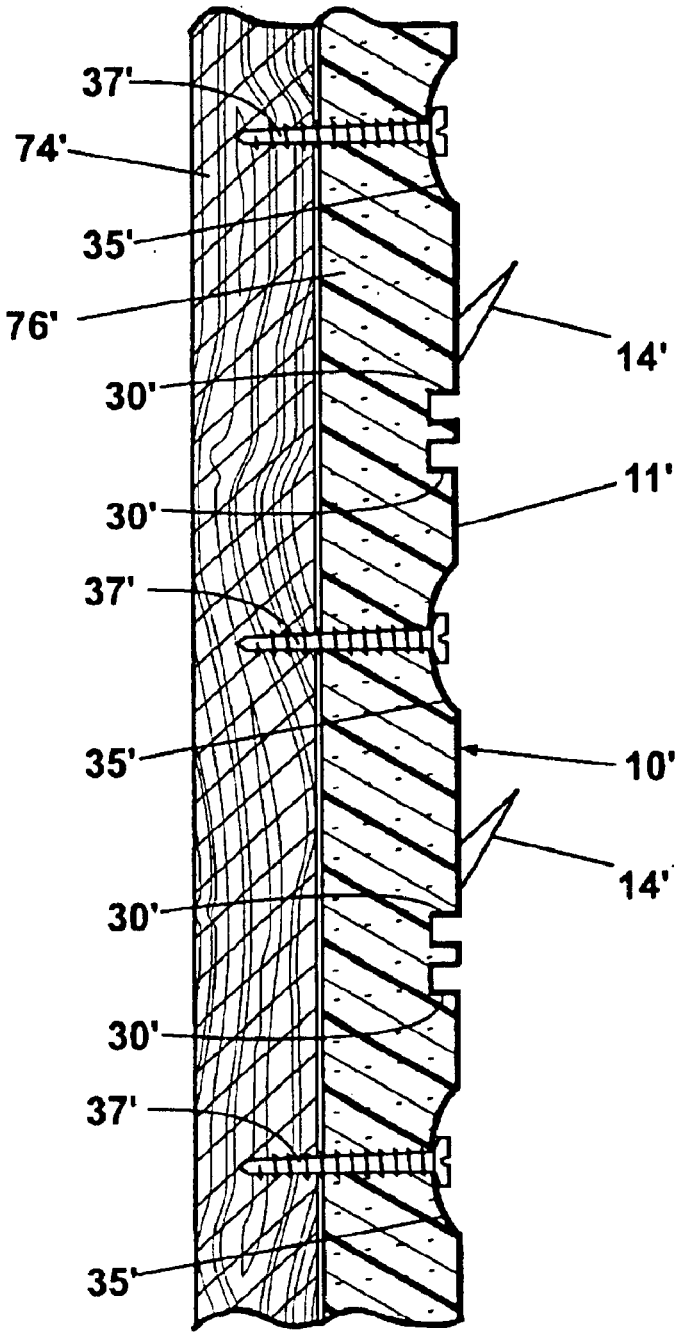
FIG. 12 is a side edge sectional view similar to FIG. 4 showing a block holder bonded to a foam board backing.

As an alternative to mounting the panels over foam board as separate elements, panels 11' in FIG. 12 are bonded by contact adhesive to a polystyrene foam board backing 76' (which may be ½ to 2 inches thick). In panel 11', lance openings 30' desirably are the same depth as recessed portions 35' and the foam board is grooved so that the lance openings and recessed portions fit into the foam backing. This maximizes the contact area for the contact cement. The adhesive for the bricks includes a solvent that erodes the foam that it contacts, so the adhesive makes its own opening in the foam to lock the bricks on the panel. In this construction the bonded foam board and panel are installed as one unit on the side of the building.

It should be understood that the foregoing embodiments are merely exemplary of the preferred practice of the present invention and that various changes and modifications may be made in the arrangements and details of the construction of the embodiment disclosed herein without departing from the spirit and scope of the present invention, as defined in the appended claims.

I claim:

1. A building block holder for supporting and positioning thin bricks or other building blocks in a spaced relationship on a wall, wherein there are gaps between the blocks that are to be filled with mortar, the building block holder comprising a panel formed of sheet material that is adapted to be fastened to the side of a building, the panel comprising a plurality of vertically spaced rows of horizontally spaced block support elements extending outwardly from the panel, the rows being spaced vertically apart by the height of the blocks and the gap between the blocks, the block support elements having portions thereof that extend at a nonperpendicular angle with respect to the panel, such that when the gap between the blocks is filled with mortar and the mortar is permitted to dry, the mortar is locked on the panel by engagement with a rear side of the nonperpendicular portions of the elements, the mortar in-turn being secured to the blocks and locking the blocks on the panel, the sheet material being a material that can be cut and deformed in a stamping operation, the block support elements comprising a plurality of prongs stamped out of the panels so as to leave a hole in the panel at least partially behind the prongs, said prongs extending upwardly and outwardly from the panel at an acute angle and terminating at an upper end that supports the blocks, the prongs having upwardly extending reinforcement ridges therein that provide reinforcement to the prongs so as to restrain the prongs from being deformed during handling or storage or being bent downwardly when a block is mounted thereon.

2. A building block holder according to to claim 1 and further comprising glue locks in the panel, the glue locks being positioned so as to be behind the blocks, the glue locks comprising openings in the panel that glue can penetrate when placed between the blocks and the panel, such that the glue can flow partially behind the panel when it dries, locking the glue to the panel.

3. A building block holder according to claim 1 wherein the panel comprises a plurality of rearwardly deformed portions that space the panel outwardly from a substrate on which the panel is mounted, said portions also serving as recessed locations through which mounting screws can be extended to mount the panel on the substrate, the recessed portions permitting the heads of the screws to be recessed in the panel so as not to prevent the blocks from lying flat against the panel.

4. A building block holder according to claim 1 wherein a lower end of the panel includes an outwardly extending flange that runs along the lower end of the panel.

5. A building block holder according to claim 1 wherein the prongs have a generally inverted V-shape.

6. A building block holder for supporting and positioning thin bricks or other building blocks in a spaced relationship on a wall, wherein there are gaps between the blocks that are to be filled with mortar, the building block holder comprising a panel formed of sheet material that is adapted to be fastened to the side of a building, the panel comprising a plurality of vertically spaced rows of horizontally spaced block support elements extending outwardly from the panel, the rows being spaced vertically apart by the height of the blocks and the gap between the blocks, the block support elements having portions thereof that extend at a nonperpendicular angle with respect to the panel, such that when the gap between the blocks is filled with mortar and the mortar is permitted to dry, the mortar is locked on the panel by engagement with a rear side of the nonperpendicular portions of the elements, the mortar in turn being secured to the blocks and locking the blocks on the panel, a lower edge of the panel being displaced outwardly from a rear surface of the panel such that an upper edge of a like panel positioned below the panel will fit behind the lower edge, the upper edge of the panel having an outwardly extending flange thereon that engages the lower edge of a like panel positioned above the panel so as to limit overlap of the panels.

7. A building block holder for supporting and positioning thin bricks or other building blocks in a spaced relationship on a wall, wherein there are gaps between the blocks that are to be filled with mortar, the building block holder comprising a panel formed of sheet material that is adapted to be fastened to the side of a building, the panel comprising a plurality of vertically spaced rows of horizontally spaced block support elements extending outwardly from the panel, the rows being spaced vertically apart by the height of the blocks and the gap between the blocks, the block support elements having portions thereof that extend at a nonperpendicular angle with respect to the panel, such that when the gap between the blocks is filled with mortar and the mortar is permitted to dry, the mortar is locked on the panel by engagement with a rear side of the nonperpendicular portions of the elements, the mortar in turn being secured to the blocks and locking the blocks on the panel, the building block holder further comprising a mounting shelf for mounting elongated blocks on their ends, the shelf including a vertical back plate with an outwardly extending flange at a lower edge thereof, the back plate having a rearwardly recessed portion that mates with a rearwardly recessed portion of the block holder panel, the mating recessed portion properly positioning the shelf on the panel and providing resistance to vertical displacement of the shelf on the panel.

8. A building block holder for supporting and positioning thin bricks or other building blocks in a spaced relationship on a wall, wherein there are gaps between the blocks that are to be filled with mortar, the building block holder comprising a panel formed of sheet material that is adapted to be fastened to the side of a building, the panel comprising a plurality of vertically spaced rows of horizontally spaced block support elements extending outwardly from the panel, the rows being spaced vertically apart by the height of the blocks and the gap between the blocks, the block support elements having portions thereof that extend at a nonperpendicular angle with respect to the panel, such that when the gap between the blocks is filled with mortar and the mortar is permitted to dry, the mortar is locked on the panel by engagement with a rear side of the nonperpendicular portions of the elements, the mortar in turn being secured to the blocks and locking the blocks on the panel, the building block holder further comprising a corner element that fits on the corner of a building, the corner element including a right angle panel having offset mounting flanges at outer edges thereof, the panel being spaced from a substrate by the flanges, the panel including glue locks that secure L-shaped blocks to the surface thereof.

* * * * *